US010863772B2

(12) United States Patent
Borkovec et al.

(10) Patent No.: US 10,863,772 B2
(45) Date of Patent: Dec. 15, 2020

(54) ELECTRONIC SMOKING DEVICE WITH TWO PARALLEL FLOW PATHS HAVING A CONSTANT TOTAL FLOW RESISTANCE

(71) Applicant: Fontem Holdings 1 B.V., Amsterdam (NL)

(72) Inventors: Vaclav Borkovec, Hamburg (DE); Stefan Biel, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 285 days.

(21) Appl. No.: 15/766,794

(22) PCT Filed: Oct. 17, 2016

(86) PCT No.: PCT/EP2016/074876
§ 371 (c)(1),
(2) Date: Apr. 6, 2018

(87) PCT Pub. No.: WO2017/064323
PCT Pub. Date: Apr. 20, 2017

(65) Prior Publication Data

US 2018/0295884 A1 Oct. 18, 2018

(30) Foreign Application Priority Data

Oct. 16, 2015 (EP) ..... 15190226

(51) Int. Cl.
*A24F 47/00* (2020.01)

(52) U.S. Cl.
CPC ..... *A24F 47/008* (2013.01)

(58) Field of Classification Search
CPC ..... A24F 47/008; A24F 40/44; A24D 3/00
See application file for complete search history.

(56) References Cited

U.S. PATENT DOCUMENTS

| | | | | |
|---|---|---|---|---|
| 4,898,190 | A * | 2/1990 | Deal | A24D 3/041 131/198.2 |
| 2014/0261488 | A1 | 9/2014 | Tucker | |
| 2015/0122277 | A1* | 5/2015 | Frobisher | A24D 3/043 131/329 |
| 2015/0258288 | A1 | 9/2015 | Sullivan | |

FOREIGN PATENT DOCUMENTS

| | | | |
|---|---|---|---|
| CN | 103827650 | A | 5/2014 |
| CN | 103945716 | A | 7/2014 |
| CN | 203952434 | U | 11/2014 |
| CN | 204207071 | U | 3/2015 |
| EP | 0845220 | A1 | 6/1998 |
| WO | 2013050934 | A1 | 4/2013 |
| WO | 2013093470 | A2 | 6/2013 |
| WO | 2015042412 | A1 | 3/2015 |

* cited by examiner

*Primary Examiner* — Eric Yaary
*Assistant Examiner* — Jennifer A Kessie
(74) *Attorney, Agent, or Firm* — Dykema Gossett PLLC

(57) ABSTRACT

The invention relates to an electronic smoking device (10) with a first gas conduit (42) and a second gas conduit (46), wherein an atomizer (26) is arranged in the first gas conduit (42) and the second gas conduit bypasses the first gas conduit (42). In order to be able to change particle sizes of vapor provided by the atomizer (26), the electronic smoking device (10) is adapted to change flow resistances of the first and the second gas conduits (42, 44), while maintaining a total flow resistance of the first and the second gas conduits (42, 44).

15 Claims, 3 Drawing Sheets

ELECTRONIC SMOKING DEVICE WITH TWO PARALLEL FLOW PATHS HAVING A CONSTANT TOTAL FLOW RESISTANCE

CROSS-REFERENCE TO RELATED APPLICATIONS

This application is a national stage application based upon International application no. PCT/EP2016/074876, filed 17 Oct. 2016 and published in English on 20 Apr. 2017 under International publication no. WO/2017/064323 (the '876 application); which claims priority to European application no. 15190226.9, filed 16 Oct. 2015 and published in English on 19 Apr. 2017 under publication no. EP3155910 (the '226 application). The '876 application and the'226 application are both hereby incorporated by reference as though fully set forth herein.

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other electronic smoking devices, a switch is used to power up the electronic smoking device to generate a puff of vapor.

Particle sizes of the vaporized or atomized liquids influence user experience. For example, larger particle sizes, i.e. particle sized up to 3 μm, make nicotine absorption more efficient such that less nicotine needs to be delivered. However, the visibility of aerosol comprising the vaporized or atomized liquid deteriorates with increasing particle size, which affects user experience. Many users wish to be able to choose between high visibility of vapor and high nicotine absorption, e.g. depending on the occasion.

SUMMARY OF THE INVENTION

In accordance with one aspect of the present invention there is provided an electronic smoking device comprising an atomizer, a first gas conduit and a second gas conduit. The atomizer is arranged in the first gas conduit. The second gas conduit bypasses the first gas conduit. Flow resistances of the first and the second gas conduits are changeable while essentially maintaining the total flow resistance of the first and the second gas conduits.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
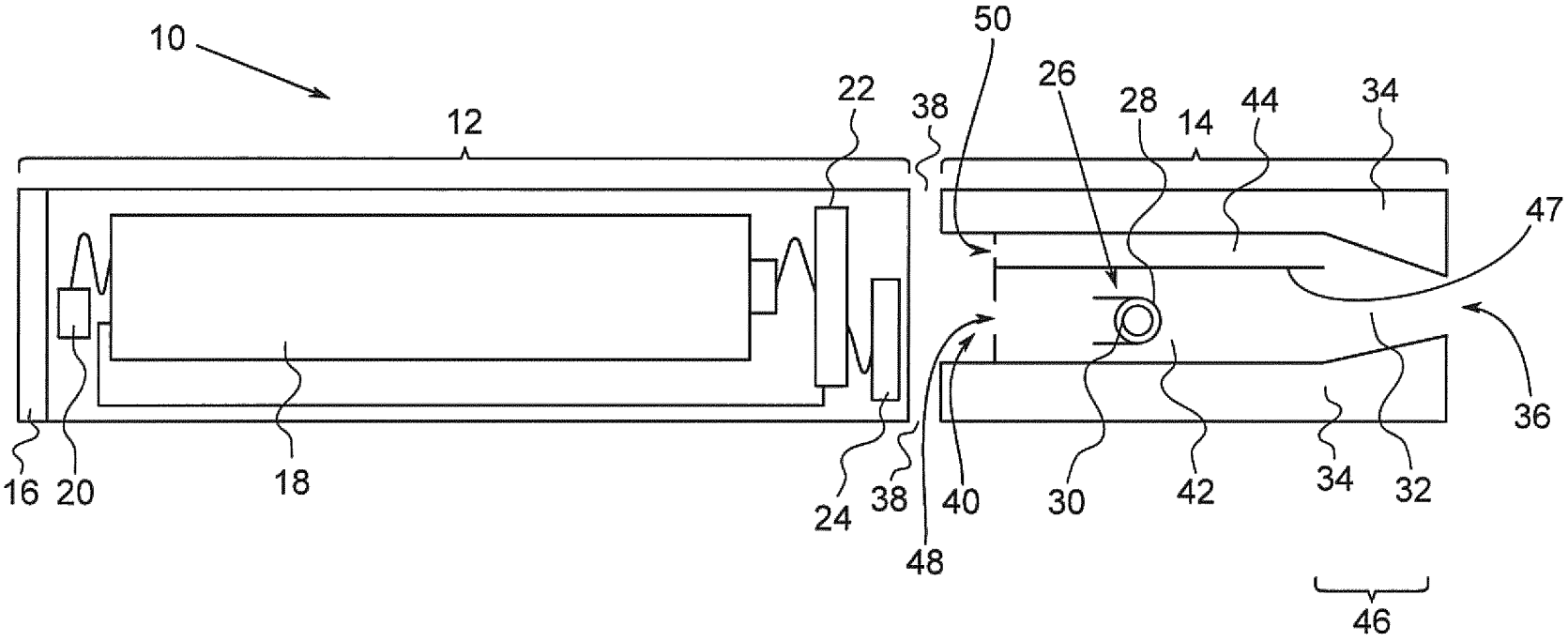
FIG. 1: is a schematic cross-sectional illustration of an exemplary embodiment of an electronic smoking device.

Throughout the following, an electronic smoking device will be exemplarily described. The electronic smoking device may be an e-cigarette. As is shown in FIG. 1, an electronic smoking device 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a battery portion 12 and an atomizer/liquid reservoir portion 14. Together the battery portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The battery portion 12 and atomizer/liquid reservoir portion 14 are typically made of metal, e.g. steel or aluminum, or of hardwearing plastic and act together with the end cap 16 to provide a housing to contain the components of the electronic smoking device 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, anywhere along the length of the atomizing portion, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, the LED 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. Yet, wires interconnecting the control electronics 22 and the atomizer 26 are omitted in FIG. 1, for the sake of simplicity. In the example shown, the atomizer 26 includes a heating coil 28, which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as wickless heating coils connected to a micro-pump, ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28. The liquid may also be supplied via a micro-pump to a needle inserted through a heating coil element, the needle being porous allowing liquid to escape to the inside of the coil eliminating the need for a wick.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity. If a micro-pump is used instead of a porous wick, the liquid reservoir could be located adjacent to the atomizing portion with the pump connecting the reservoir to the element.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the electronic smoking device 10. This causes air to be drawn into the electronic smoking device 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the electronic smoking device 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34, after which the electronic smoking device 10 is disposed of. In other embodiments the battery 18 is rechargeable and/or the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the electronic smoking device 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical electronic smoking device 10, variations also exist. For example, the LED 20 may be omitted. The airflow sensor 24 may be placed adjacent the end cap 16 rather than in the middle of electronic smoking device. The airflow sensor 24 may be replaced with a switch which enables a user to activate the electronic smoking device manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Within the central passage 32, a flow divider 40 is arranged. The flow divider 40 comprises a first gas conduit 42 and a second gas conduit 44. The hole interconnects the surrounding of the electronic smoking device 10 with the central passage 32, e.g. in a gas conducting manner. The atomizer 26 is arranged in the first gas conduit 42. The second gas conduit 44 bypasses the first gas conduit 42. Air drawn into the electronic smoking device 10 via the air inlets 38 enters the central passage 32. The volume flow rate of air that entered the electronic smoking device 10 is divided by the flow divider 40, such that a first part of the volume flow rate of the air flows through the first gas conduit 42 and a second part of the volume flow rate flows through the second gas conduit 44 towards the air inhalation port 36. Air that flows through the second gas conduit 44 does not pass or contact the atomizer 26 but, rather, mixes with the aerosol formed by the first part of volume flow rate and liquid vaporized by the atomizer 26 in a mixing area 46 that is arranged between the flow divider 40 and the air inhalation port 36. A separation wall 47 separates the first second gas conduit 42 from second gas conduit 44, the separation wall 47 essentially extending parallel to an outer side wall of the electronic smoking device 10.

At a given pressure difference between the air inlets 38 and the air inhalation port 36, air with a given volume flow rate flows through the electronic smoking device 10. The flow resistances of the first and second gas conduits 42, 44 are changeable while maintaining the total flow resistance of the first and the second gas conduits 42, 44. Hence, at the given pressure difference, the given flow volume rate remains stable, even if the flow resistances of the first and second gas conduits 42, 44 are changed. For example, the flow resistance of the first gas conduit 42 can be increased and the flow resistance of the second gas conduit 44 can be decreased or vice versa.

Due to the change of flow resistance, a different amount of air flows along the atomizer 26, which changes the particle size of the aerosol formed by the vaporized liquid and the air that mixes with the vaporized liquid. This gaseous dilution of the vaporized liquid with air influences the condensation of the vaporized liquid into droplets, i.e. the particles of the aerosol. Hence, at a given pressure difference, which may result from the preferred smoking behavior of the user, the particle size of the aerosol can be preselected in hardware by the flow resistance of the first gas conduit 42. In order to provide that the same total volume flow rate reaches the user via the air inhalation port 36, the change of gas flow through the first gas conduit 42 due to the changed flow resistance is compensated or counterbalanced by the second gas conduit 44, whose flow resistance is adapted in order to compensate or counterbalance the change of the flow resistance of the first gas conduit 42.

Instead of describing the invention by using the term flow resistance, the term pressure loss of drop may be used. Hence, in case the user changes pressure drop or loss over one of the first and second gas conduits 42, 44, the pressure drop of loss of the other one of the first and second gas conduits 42, 44 is changed in order to compensate for the change of the pressure drop or loss over the one of the first and second gas conduits 42, 44, such that the total pressure drop over both of the first and second gas conduits 42, 44 or over the flow divider is not changed, but, rather, maintained in case a given pressure difference is present between the air inlets 38 and the air inhalation port 38.

In order to change the flow resistances of the first and second gas conduits 42, 44, a flow obstacle, e.g. a meandering flow path, may be moved from the first to the second gas conduit 42, 44. Alternatively, a flow obstacle may be introduced into one of the gas conduits 42, 44, and another flow obstacle may be removed from the other one of the gas conduits 44, 42. Furthermore, a diameter, form or size of clear openings of the respective gas conduit 42, 44 can be changed in order to change the flow resistance.

The first and the second gas conduits 42, 44 as such may have identical flow resistances, for example in case not flow obstacle is arranged in any of the first and the second gas conduits 42, 44.

For the sake of convenience, the electronic smoking device 10 is adapted to let the user of the electronic smoking device 10 change the flow resistance of the first gas conduit 42 or of the second gas conduit 44. For example, the user can change the flow resistance of either the first gas conduit 42 or of the second gas conduit 44. The flow resistance of the gas conduit 42, 44 that cannot directly be influenced by the user is adapted automatically by the electronic smoking device 10.

The electronic smoking device 10 according to the exemplary embodiment of FIG. 1 comprises a first flow-through opening 48 and a second flow-through opening 50. The first flow-through opening 48 is in communication and for example exclusively in communication with the first gas conduit 42. The second flow-through opening 50 is in communication and for example exclusively in communication with the second gas conduit 44. Being in communication or in exclusive communication with a gas conduit means that no gas which flows through one of the conduits flows through the flow-through opening of the other one of the gas conduits. Hence, the gas conduits are separated from each other and are provided parallel to each other.

Each of the flow-through openings 48, 50 can be a gas inlet opening, via which air from the air inlets 38 enters the respective gas conduit 42, 44 when the user sucks on the air inhalation port 36. Alternatively, each of the flow-through openings 48, 50 can be a gas outlet opening, via which air leaves the respective gas conduit 42, 44 in order to flow towards the air inhalation port 36. Furthermore, each of the flow-through openings 48, 50 can be an intermediate flow-through opening that is arranged in the course of the respective gas conduit 42, 44. The first flow-through opening 48 is arranged differently from or identically to the second flow-through opening 50. For example, both of the flow-through openings 48, 50 are shown as gas inlets in the exemplary embodiment of FIG. 1. Alternatively, for example, the first flow-through opening 48 is a gas inlet and the second flow-through opening 50 is a gas outlet or an intermediate flow-through opening.

The first and the second flow-through openings 48, 50 can be adapted to have variable sizes, e.g. sizes of cross-sections or sizes or diameters of clear openings formed by the flow-through openings. The size of the second flow-through opening 50 depends on the size of the first flow-through opening 42. For example, the dependence of the sizes is in inversely proportional.

The first and the second gas conduits 42, 44 as such may have identical flow resistances, for example in case the first and the second flow-through openings 48, 50 have identical sizes.

According to another exemplary embodiment, the electronic smoking device 10 comprises a gas flow-through element with a first opening forming the first flow-through opening 48, and a second opening forming the second flow-through opening 50, the gas flow-through element being repeatedly mountable to and demountable from or being rotatably mounted in the electronic smoking device 10.

Figure 4:
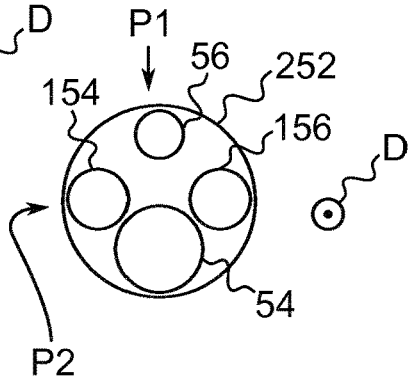
Figure 5:
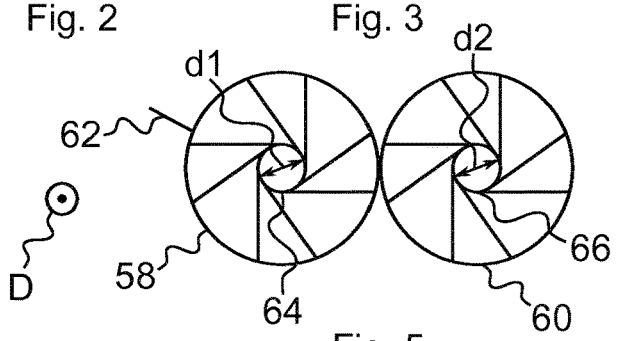
FIGS. 5 to 7: show exemplary embodiments of diaphragms comprising flow-through openings of the electronic smoking device.

Exemplary embodiments of gas flow-through elements are described with respect to FIGS. 4 to 5. Flow-through elements with variable sizes are discussed with respect to FIGS. 5 to 7 in the following.

Figure 2:
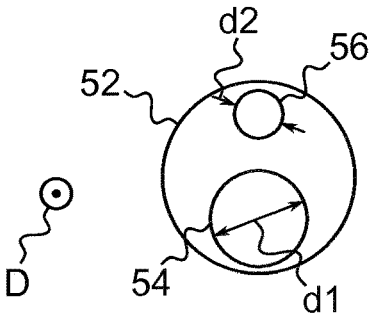
FIGS. 2 to 4: show exemplary embodiments of gas flow-through elements comprising flow-through openings of the electronic smoking device.
Figure 3:
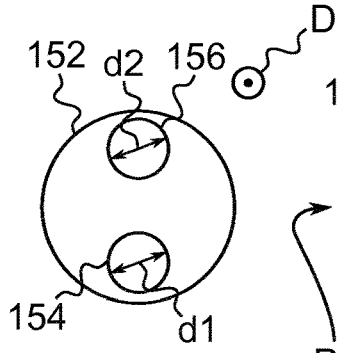

FIGS. 2 to 4 show exemplary embodiments of gas flow-through elements, which are schematically depicted with a flow-through direction D perpendicular to the plane of projection. First and second openings of the gas flow-through elements extend parallel to the flow-through direction D through the gas flow-through element. In the flow direction D, air flows through the openings of the respective flow-through element in case the flow-through element is mounted to the electronic smoking device 10 and the sucks on the air inhalation port 36. The gas flow-through element may be formed as a disc that is aligned essentially perpendicular to the flow-through direction D in case the flow-through element is mounted to the electronic smoking device 10.

FIG. 2 shows the gas flow-through element 52 with a first and a second opening 54, 56. The first opening 54 has a size and for example a diameter d1 that is larger than a diameter d2 of the second opening 56. In case the gas flow-through element 52 is mounted to the electronic smoking device 10 and the first opening 54 is in communication, e.g. in exclusive communication, with the first gas conduit 42, the first opening 54 forms the first flow-through opening 48. In this case, the second opening 56 forms the second flow-through opening 50.

However, the gas flow-through element 52 may be rotatable within the electronic smoking device 10 or can have different mounting positions. Thus, the first opening 54 can be arranged to be in communication with the second gas conduit 44, such that the first opening 54 forms the second flow-through opening 50 and the second opening 56 forms the first flow-through opening 48 in case the flow-through element 52 is in another rotational or mounted position.

FIG. 3 shows another gas flow-through element 152 with first and second openings 154, 156 having identical sizes, for example identical diameters d1, d2. This gas flow-through element 152 may be a replacement part for the gas flow-through element 52 of FIG. 2, in case the user wishes to change the particle size not by exchanging the first and second openings 54, 56 with each other, but by replacing the gas flow-through element 52 with the gas flow-through element 152.

FIG. 4 shows another exemplary embodiment of the gas flow-through element 252 comprises at least two pairs P1, P2 of first and second openings 54, 56, 154, 156. Pair P1 comprises first and second openings 54, 56 and pair P2 comprises first and second openings 154, 156. The pairs P1, P2 can respectively be brought into communication with the first and second gas conduits 42, 44. For example, the first opening 54 is in communication with the first gas conduit 42 and the second opening 56 is in communication with the second gas conduit 44.

Alternatively, the first openings 154 is in communication with the first gas conduit 42 and the second opening 156 is in communication with the second gas conduit 44. Hence, the openings of each of the pairs P1, P2 can form the first flow-through opening 48 and the second flow-through opening 50.

The pairs P1, P2 comprise differently sized first openings 54, 154. The total size of the first and second openings 54, 56 of one of the pairs P1, however, corresponds to the total size of the first and second openings 154, 156 of the other one of the pairs P2.

The gas flow-through element 52, 152, 252 can be a gas inlet element that is arranged between the air inlets 38 and the atomizer 26. Alternatively, the gas flow-through element 52, 152, 252 is a gas outlet element arranged between the atomizer 26 and the air inhalation port 36, or an intermediate flow-through element that is arranged in the course of the first and second gas conduits 42,44.

Figure 6:
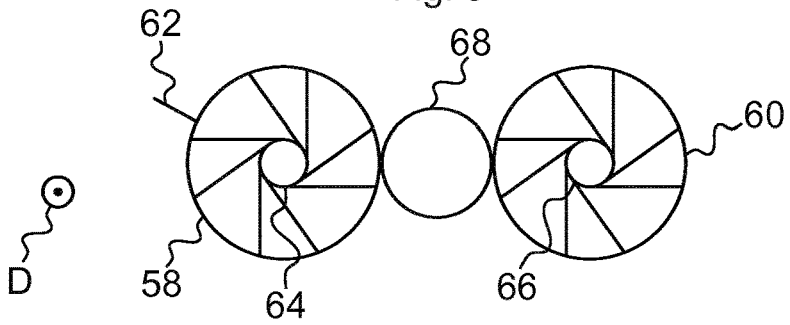
Figure 7:
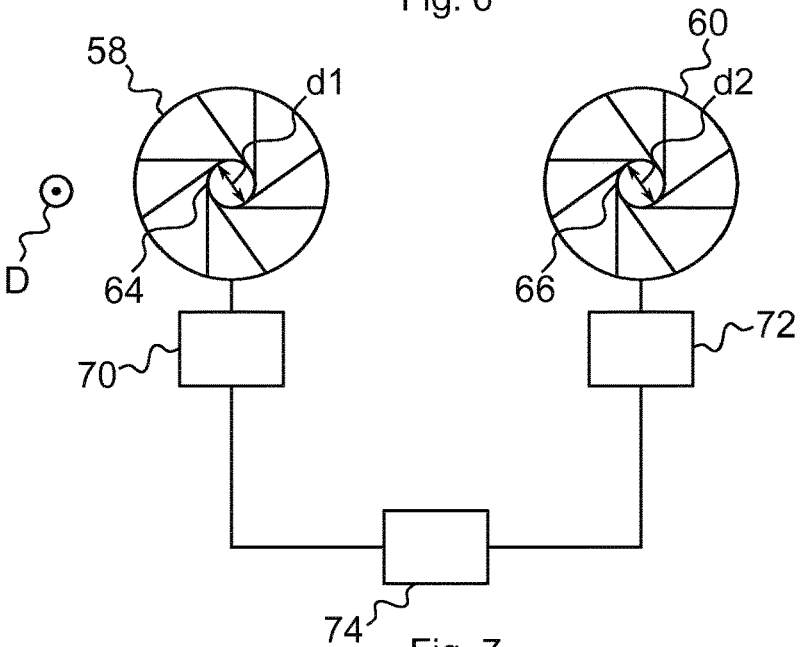

FIGS. 5 to 7 schematically show diaphragms of another exemplary embodiment of the electronic smoking device. Apertures, e.g. openings, of the diaphragms extend along a flow-through direction D that extends perpendicular to the plane of projection. Perpendicular to the flow-through direction D, the apertures have variable or changeable sizes. The opening of one of the diaphragms is the first flow-through opening 48 and the opening of the other of the diaphragms of the second flow-through opening 50.

FIG. 5 shows two diaphragms 58, 60. Diaphragm 58 comprises an operating element 62, via which a user of the electronic smoking device 10 can operate diaphragm 58 and change the diameter d1 of the opening 64 of diaphragm 58.

Diaphragm 58 is directly mechanically coupled to a diaphragm 60, such that changing the diameter of opening 64 results in a change of the diameter d2 of opening 66 of diaphragm 60. In particular, the change of diameters is inversely proportional.

FIG. 6 shows another exemplary embodiment, wherein the diaphragms 58, 60 are mechanically coupled by a rotation transfer element 68, for example a gear wheel or a friction washer.

The diaphragms 58, 60 of the exemplary embodiment of FIG. 7 are not mechanically coupled in order to transmit a rotational movement from one of the diaphragms 58 to the other one of the diaphragms 60. Furthermore, at least one of the diaphragms 58, 60 and for example both of the diaphragms 58, 60 is driven by a motor 70, 72, the motor e.g. being an electromotor. The motors 70, 72 are connected to the diaphragms 58, 60 in order to introduce a rotational movement into the diaphragms 58, 60, which results in a change of diameter d1, d2 of the openings 64, 66 of the respective diaphragm 58, 60. The motors 70, 72 are connected to a control unit 74 in a control signal-transmitting manner. Via the control unit 74, a user request for changing the diameters d1, d2 is received and transmitted to the motors 70, 72.

Alternatively, one of the motors 70 is replaced by a sensor that senses a rotation or a position of the operating element 62 of the diaphragm 58 that is equipped with the operating element 62. The sensor is connected to the control unit 74, e.g. in a sensor signal transmitting manner. The control signal is representative for a movement or a position of the operating element 62 and, thus, for the size of the opening 64. Based on the sensor signal, the control unit 74 controls the motor 72 that moves the other diaphragm 60 to change the size of its opening 66.

For example, opening 64 of diaphragm 58 is in communication with the first gas conduit 42 and forms the first flow-through opening 48. The opening 66 of diaphragm 60 is for example in communication with the second gas conduit 44 and forms the second flow-through opening 50. The control unit 74 may be provided separate of or integral with the control electronics 22 of the electronic smoking device 10.

According to another exemplary embodiment, the electronic smoking device 10 and for example its control unit 74 is adapted to adjust the ratio of the flow resistances of the first and the second gas conduits 42, 44 dependent on a flow rate of air passing through the electronic smoking device 10 when it is in use. Thus, the user can adjust the particle size by sucking harder/slower while keeping the same overall flow resistance. For example, the flow rate can be measured by a flow rate sensor, e.g. the air flow sensor 24. Alternatively to the electrically adjusted diaphragms, pressure-dependent valves are used to change the flow resistances.

The electronic smoking device 10 can be adapted to change the atomization power supplied to the atomizer 26 depending on the flow resistance of one of the first and the second gas conduits 42, 44 and in particular of the first gas conduit 42.

For example, the electronic smoking device 10 is adapted to change the atomization power depending on the size of the first flow-through opening 48, 50 that may be represented by a movement or a position of the operating element 62 the user uses for changing the size of the first flow-through opening 48, 50. The electronic smoking device 10 may comprise a sensor that senses a rotation or a position of the operating element, wherein the sensor may be connected to a control unit 74 of the electronic smoking device 10, e.g. in a control signal transmitting manner. This sensor may be the sensor mentioned above concerning motor controlled change of opening size or may be a separate sensor. The control unit 74 may control atomization power.

Figure 8:
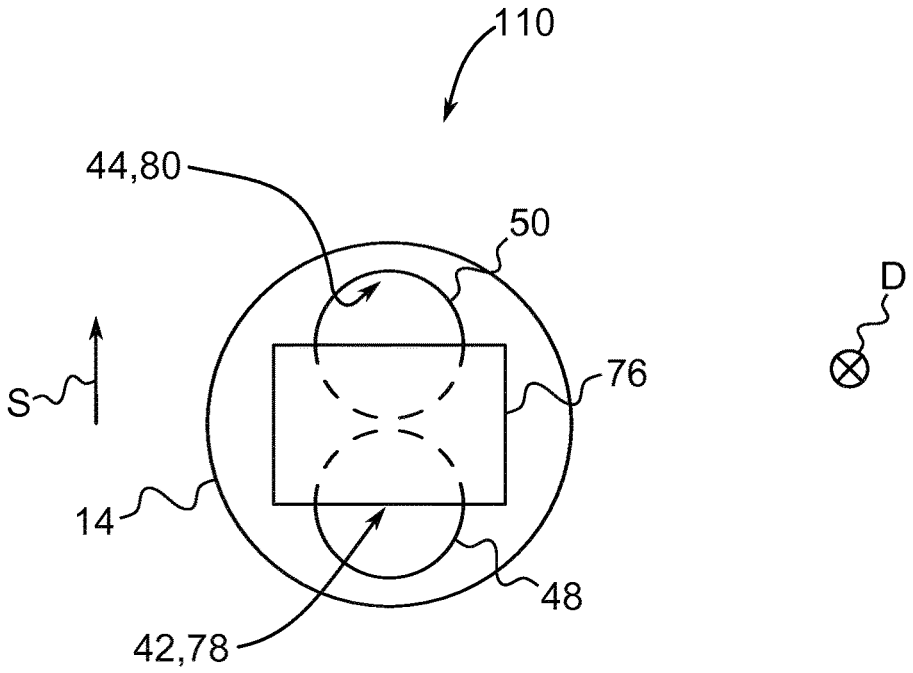
FIG. 8: shows another exemplary embodiment of the electronic smoking device.

FIG. 8 shows another exemplary embodiment of the electronic smoking device 110 in a cross-sectional schematic view. The cross-sectional plane extends perpendicular to the flow-through direction D and parallel to the plane of projection. In particular, the cross-sectional plane extends through the air inlets 38 such that the atomizer/liquid reservoir portion 14 is shown in FIG. 8 with the air inhalation port 36 facing the plane of projection and the flow-through openings 48, 50 facing out of the plane of projection. For example, the flow-through openings 48, 50 are inlet openings of the first and the second gas conduits 42, 44.

The electronic smoking device 110 comprises a sliding obstruction 76 that is at least sectionwise arranged across at least one of the first and the second gas conduits 42, 44.

Hence, the sliding obstruction 76 at least partly blocks at least one of the first and the second gas conduits 42, 44. By blocking the respective gas conduit 42, 44, the flow resistance of the respective gas conduit 42, 44 is changed. For example, the sliding obstruction 76 is arranged in the course of the first and the second gas conduits 42, 44. Yet, in the exemplary embodiment, the sliding obstruction 76 at least partly covers or blocks at least one of the flow-through openings 48, 50.

The sliding obstruction 76 is adapted to be slidable in a sliding direction S. For example, the sliding direction S extends perpendicular to the flow-through direction D and/or points from the first gas conduit 42 or the first flow-through opening 48 towards the second gas conduit 44 or the second flow-through opening 50, possibly at an angle equal, smaller or greater than 90 degrees to the flow-through direction D, along which the first and second gas conduits 42, 44 extend.

Clear areas 78, 80 remain between the sliding obstruction 76 and sidewalls of the first and second gas conduits 42, 44 or the flow-through openings 48, 50, respectively, that allow for gas flow. By sliding the sliding obstruction 76 in or against the sliding direction S, the size of each of the clear areas 78, 80 is changed. The total size, i.e. the sum of the sizes, of the clear areas 78, 80 is not changed, but is maintained.

The sliding obstruction 76 and the first and second gas conduits 42, 44 or the flow-through openings 48, 50 can be formed in order to maintain the total size of the clear areas 78, 80 irrespective of the sliding position of the sliding obstruction 76. For example, as shown in FIG. 8, diameters of the first and second gas conduits 42, 44 or the flow-through openings 48, 50 at least at the sliding obstruction may be identical.

Figure 9:
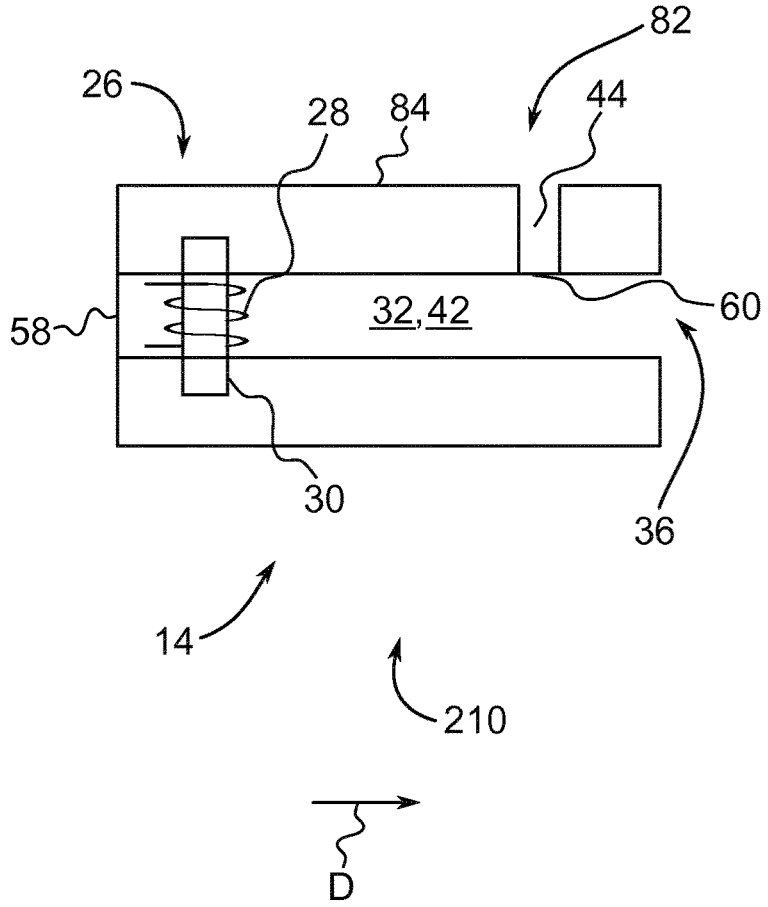
FIG. 9: shows yet another exemplary embodiment of the electronic smoking device.

FIG. 9 shows yet another exemplary embodiment of the electronic smoking device 210 in a schematic cross-sectional view that essentially corresponds to the view of FIG. 1, whereby only the atomizer/liquid reservoir portion 14 is shown in FIG. 9. For the sake of brevity, only the differences from the exemplary embodiment of FIG. 1 are looked at in the following.

The electronic smoking device 210 is shown without the flow divider 40 shown in FIG. 1. Rather, merely the atomizer 26 with the wick 30 and the heating coil 28 are present in the central passage 32. Hence, the central passage 32 forms the first gas conduit. Additionally, diaphragm 58 is shown, the opening 64 of which being in communication with the central passage 32 and the air inlets 38, such that air that entered the electronic smoking device 210 via the air inlets 38 flows through the opening 64 into the central passage. For example, the diaphragm 58 is placed opposite of the air inhalation port 36, such that the atomizer 26 is arranged between the diaphragm 58 and the air inhalation port 26 and the opening 64 is an inlet opening. Alternatively, the diaphragm 58 may be placed closer to the atomizer 26 or even between the atomizer 26 and the air inhalation port 36.

The second gas conduit 44 is formed by a lateral conduit 82 that extends from an outer sidewall 82 of the atomizer/liquid reservoir portion 14 to the central passage 32. For example, the lateral conduit 82 essentially extends perpendicular to the central passage 32 or at an angle to the central passage 32 that is smaller or greater than 90 degrees.

At an end or in the course of the lateral conduit 82, the diaphragm 60 may be arranged. For example, the diaphragm 60 is arranged at an inner end of the lateral conduit 82 that abuts the central passage 32. Hence, via the opening 66 of the diaphragm 60, the second gas conduit 44 opens into the central passage 32.

Hence, the second gas conduit 44 may be in a different location than the first gas conduit 42.

Alternatively to the exemplary embodiment of FIG. 9, the electronic smoking device 10 of FIG. 1 may by provided with the lateral opening 82 that may or may not comprise the diaphragm 60.

In summary, in one aspect, the electronic smoking device comprises an atomizer, a first gas conduit and a second gas conduit, the atomizer being arranged in the first gas conduit and the second gas conduit bypassing the first gas conduit. In order to enable the user to adapt particle sizes of aerosol produced by the electronic smoking device, flow resistances of the first and the second gas conduits are changeable while maintaining the total flow resistance of the first and second gas conduits.

An advantage of such an electronic smoking device may be that the user can enjoy vapor with different particle sizes, i.e. vapor that is better visible or that delivers nicotine more efficiently, without changing his vaping or smoking habits.

For example, flow resistances of the gas conduits can be changed by introducing or removing flow obstacles into or from the gas conduits. The flow obstacles may form a flow labyrinth, for example a meandering flow path. Alternatively, the electronic smoking device may have at least one sliding obstruction that sits across both conduits and for example at least sectionwise covers the first and the second flow-through openings, whereby sliding the obstruction in a sliding direction increases the flow resistance of one conduit while decreasing it in the other (at the appropriate ratio). Hence, the sliding obstruction blocks air flow into the respective gas conduit. Alternatively, changing the flow resistance may a result of changing diameters, cross sections or other sizes of clear openings of the gas conduits.

At a given pressure difference, different flow resistances result in different volume flow rates of air flowing through the respective gas conduit. The flow resistance depends on the geometry of the gas conduits and can be influenced by changing the geometry of at least a part of the respective gas conduit. Flow resistance can be easily determined by applying a known pressure difference and measuring the volume flow rate through the respective gas conduit.

Instead of describing the invention by using the term flow resistance, the term pressure loss of drop may be used. Hence, in case the user changes pressure drop or loss over one of the first and second gas conduits, the pressure drop of loss of the other one of the first and second gas conduits is changed in order to compensate for the change of the pressure drop or loss over the one of the first and second gas conduits, such that the total pressure drop over both of the first and second gas conduits is not changed, but, rather, maintained in case a given pressure difference is present between the air inlets and the air inhalation port.

The electronic smoking device may be adapted to let the user of the electronic smoking device change the flow resistance of the first gas conduit or of the second gas conduit. In particular, the electronic smoking device may be adapted to let the user change the flow resistance of either the first gas conduit or of the second gas conduit. For example, the user can change the flow resistance of the first gas conduit. Furthermore, the electronic smoking device may be adapted to change the flow resistance of the gas conduit that cannot directly be changed by the user. In particular, the electronic smoking device can be adapted to change the flow resistance inversely proportional to the change of the flow resistance directly initiated by the user. Hence, the total flow resistance of the electronic smoking device can be maintained by the electronic smoking device, even in case the user changes the flow resistance of one of the gas conduits.

An advantage of this embodiment may be that the user can easily change the flow resistance, for example of the first gas conduit, in order to influence the size of the particles of vaporized liquid, wherein the electronic smoking device provides that the total flow of air through the electronic smoking device remains the same at a given pressure difference, i.e. in case the user does not change his smoking or vaping behavior.

The electronic smoking device may comprise a first flow-through opening and a second flow-through opening. The first flow-through opening can be in communication, for example in exclusive communication, with the first gas conduit. The second flow-through opening can be in communication, for example in exclusive communication, with the second gas conduit. Being in communication or in exclusive communication means that gas that flows through one of the gas conduits does not flow through the flow-through opening that is in communication with the respective other gas conduit.

An advantage of this embodiment may be that undesired mixing of gas flowing through the gas conduits is avoided and undesired influences of the change of flow resistances is avoided.

The flow-through openings may be arranged at the beginning, in the course of or at the end of the respective gas conduit. Hence, the flow-through openings may be gas inlets, intermediate gas flow-through openings or gas outlets. For example, the first and/or the second flow-through openings are each a respective gas inlet of one of the first and the second gas conduits. In particular, the gas inlet of the first gas conduit does not come into contact with vaporized liquid, thereby avoiding that residues of vaporized and eventually dried liquid unintentionally change the flow resistance, e.g. by changing the size of the first flow-through opening.

The first and the second flow-through openings may be adapted to have variable sizes, wherein the size of the second flow-through opening can depend on the size of the first flow-through opening, in particular inversely proportional. The size may be a diameter, the size of a cross-section, or the size of a clear opening of the respective flow-through opening. The total size, which is a result of an addition of the sizes of the first and the second flow-through openings, may remain constant.

The first flow-through opening may be formed as an opening, i.e. an aperture, of a first diaphragm. The second flow-through opening may be formed as an opening, i.e. an aperture, of a second diaphragm.

An advantage of this embodiment may be that diameters of openings or apertures of diaphragms can be easily changed.

The first and second diaphragms can be coupled to each other, such that a diameter of the opening of the second diaphragm changes inversely proportional to the opening of the first diaphragm.

An advantage of this embodiment may be that it is sufficient that the user changes the size of the opening of one of the diaphragms and the electronic smoking device changes the size of the opening of the other diaphragm automatically, thereby improving ease of use of the electronic smoking device.

The first and the second diaphragms are for example mechanically coupled to each other in order to transmit rotational movements which result in changes of diameters of the openings.

An advantage of this embodiment may be that the electronic smoking device is easier to produce.

The first and the second diaphragms may be electrically coupled to each other by a control unit, wherein the control unit controls at least one motor that opens and closes at least of the first and the second diaphragms.

An advantage of this embodiment may be that, unlike mechanical connections, the rate of change of size can be more easily adapted by electrically coupled diaphragms.

According to another exemplary embodiment, the electronic smoking device and for example its control unit can be adapted to adjust the ratio of the flow resistances of the first and the second gas conduits dependent on a flow rate of air passing through the electronic smoking device when it is in use. Thus, the user can adjust the particle size by sucking harder/slower while keeping the same overall flow resistance. For example, the flow rate can be measured by a flow rate sensor, e.g. the air flow sensor. Alternatively to the electrically adjusted diaphragms, pressure-dependent valves are used to change the flow resistances.

An advantage of this embodiment may be that usage of the electronic smoking device is further facilitated.

The electronic smoking device may comprise a gas flow-through element with a first and a second opening. The first opening may form the first flow-through opening and the second opening may form the second flow-through opening. The gas flow-through element can be repeatedly mountable to and removable from the electronic smoking device. For example, the gas flow-through element can be replaced by another gas flow-through element with differently dimensioned first and second openings. Alternatively or additionally, the gas flow-through element can be rotationally mounted in the electronic smoking device or can have two different mounted positions. In a first position, the first opening forms the first flow-through opening and the second opening forms the second flow-through opening. In the second position, the first opening forms the second flow-through opening and the second opening forms the first flow-through opening. Due to the differently dimensioned openings, the size of the first and second flow-through openings can be easily changed by rotating or by replacing the gas flow-through element.

An advantage of this embodiment may be that due to the replicability of the gas flow-through element, the user can easily change particle sizes more flexibly. In case the gas flow-through element is rotatably mounted, the user can change particle size without the need of replacing one gas flow-through element by another gas flow-through element, thereby facilitating ease of use. The gas flow-through element may even be held in an exchangeable and rotatable manner in the electronic smoking device, thereby possible providing a maximum of ease of use and flexibility.

The gas flow-through element may comprise at least two pairs of first and second openings with differently sized first openings. The pairs can be respectively brought into exclusive communication with the first and the second gas conduits. A total size of the first and second openings of one of the pairs may correspond to the total size of the first and the second openings of the other one of the pairs.

An advantage of this embodiment may be that the flow resistances can be changed more flexibly.

The gas flow-through element can be a gas inlet element.

An advantage of this embodiment may be that the gas flow-through element does not contact vapor produced by the atomizer, such that deposition of liquid on the gas flow-through element is avoided.

According to another possible embodiment, the electronic smoking device may comprise a sliding obstruction that is at least sectionwise arranged across at least one of the first and the second gas conduits. Hence, the sliding obstruction may at least partly block at least one of the first and the second gas conduits. By blocking the respective gas conduit, the flow resistance of the respective gas conduit may be changed. For example, the sliding obstruction can be arranged in the course of the first and the second gas conduits. Alternatively, the sliding obstruction may at least partly cover or block at least one of the flow-through openings.

The sliding obstruction may be adapted to be slidable in a sliding direction. For example, the sliding direction extends perpendicular to the flow-through direction through which gas flows through the respective flow-through opening in case the user sucks on the electronic smoking device. The sliding direction may point from the first gas conduit or the first flow-through opening towards the second gas conduit or the second flow-through opening, possibly under an angle equal, smaller or greater than 90 degrees to the flow-through direction, along which the first and second gas conduits extend.

Clear areas may remain between the sliding obstruction and sidewalls of the first and second gas conduits or the flow-through openings, respectively, wherein gas flows through these clear areas in case the user sucks on the electronic smoking device. By sliding the sliding obstruction 76 in or against the sliding direction S, the size of each of the clear areas 78, 80 is changed. The total size, i.e. the sum of the sizes, of the clear areas 78, 80 is not changed, but is maintained.

The sliding obstruction and the first and second gas conduits or the flow-through openings can be formed in order to maintain the total size of the clear areas irrespective of the sliding position of the sliding obstruction. For example, diameters of the first and second gas conduits or the flow-through openings at least at the sliding obstruction may be identical.

An advantage of this embodiment may be that the sliding obstruction can be formed more easily than diaphragms.

According to another possible embodiment, the electronic smoking device may be formed with a lateral conduit that extends from an outer sidewall of the atomizer/liquid reservoir portion to the central passage. The lateral conduit may open into the central passage between the atomizer and the air inhalation port. For example, the lateral conduit essentially extends perpendicular to the central passage or at an angle to the central passage that is smaller or greater than 90 degrees.

The lateral conduit may be provided instead of or in addition to the flow divider and may provide an additional gas conduit or the second gas conduit. In case the lateral conduit is provided in addition to the flow divider, the flow resistance of the lateral conduit may remain unchanged or may be changeable. If the lateral conduit is provided provides the second gas conduit, the flow divider may be omitted. Hence, merely the atomizer with the wick and the heating coil may be present in the central passage, which then forms the first gas conduit. Additionally, one of the diaphragms may be used to change the flow resistance of the first gas conduit formed by the central passage. The opening of this diaphragm may be in communication with the central passage and the air inlets, such that air that entered the electronic smoking device via the air inlets flows through the opening into the central passage when the user sucks on the electronic smoking device.

For example, the diaphragm is placed opposite of the air inhalation port, such that the atomizer is arranged between the diaphragm and the air inhalation port and the opening is an inlet opening. Alternatively, the diaphragm may be placed closer to the atomizer or even between the atomizer and the air inhalation port and/or between the atomizer and the lateral conduit, in particular the position where the lateral conduit opens into the central passage.

At an end or in the course of the lateral conduit, another one of the diaphragms may be arranged. For example, this diaphragm is arranged at an inner end of the lateral conduit that abuts the central passage. At the inner end, the lateral conduit may open into the central passage. Hence, via the opening of the diaphragm, the second gas conduit opens into the central passage.

The electronic smoking device can be adapted to change the atomization power supplied to the atomizer depending on the flow resistance of the first gas conduit.

An advantage of this embodiment may be that the particle size can be changed even more flexibly by additionally changing the atomization power.

For example, the electronic smoking device is adapted to change the atomization power depending on the size of the first flow-through opening that may be represented by a movement or a position of the operating element the user uses for changing the size. The electronic smoking device may comprise a sensor that senses a rotation or a position of the operating element, wherein the sensor may be connected to a control unit of the electronic smoking device, e.g. in a control signal transmitting manner. The control unit may control atomization power and may be provided separate of or integral with the control electronics of the electronic smoking device.

An advantage of this embodiment may be that changing particle size is even more convenient for the user and more flexible.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 110, 210 electronic smoking device
12 battery portion

14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir
36 air inhalation port
38 air inlets
40 flow divider
42 first gas conduit
44 second gas conduit
46 mixing area
47 separation wall
48 first flow-through opening
50 second flow-through opening
52, 152, 252 flow-through element
54, 154 first opening
56, 156 second opening
58, 60 diaphragm
62 operating element
64 opening of diaphragm 58
66 opening of diaphragm 60
68 rotation transfer element
70, 72 motors
74 control unit
76 sliding obstruction
78, 80 clear area
82 lateral opening
84 outer sidewall of atomizer/liquid reservoir portion 14
d1 diameter of opening 54
d2 diameter of opening 56
P1 pair of first and second openings 54, 56
P2 pair of first and second openings 154, 156
D flow-through direction
S sliding direction

What is claimed is:

1. An electronic smoking device comprising:
a first gas conduit;
a second gas conduit; and
an atomizer being arranged in the first gas conduit and the second gas conduit-bypassing the first gas conduit, wherein a flow resistance of the first gas conduit and a flow resistance of the second gas conduit are changeable while maintaining a total flow resistance of the first and the second gas conduits, and wherein a change to the flow resistance of the first gas conduit is inversely proportional to a change in the flow resistance of the second gas conduit.

2. The electronic smoking device according to claim 1, wherein the electronic smoking device is adapted to let the user of the electronic smoking device change the flow resistance of the first gas conduit or of the second gas conduit.

3. The electronic smoking device according to claim 1, wherein the electronic smoking device includes a first flow-through opening and a second flow-through opening, the first flow-through opening being in communication with the first gas conduit, and the second flow-through opening being in communication with the second gas conduit.

4. The electronic smoking device according to claim 3, wherein the first and the second flow-through openings are each a gas inlet of one of the first and second gas conduits respectively.

5. The electronic smoking device according to claim 3, wherein the first and the second flow-through openings are adapted to have variable sizes, wherein a size of the second flow-through opening depends on a size of the first flow-through opening.

6. The electronic smoking device according to claim 3, wherein the first flow-through opening is formed as an opening of a first diaphragm, and the second flow-through opening is formed as an opening of a second diaphragm.

7. The electronic smoking device according to claim 6, wherein the first and the second diaphragms are coupled to each other, such that a diameter of the opening of the second diaphragm changes inversely proportional to the diameter of the opening of the first diaphragm.

8. The electronic smoking device according to claim 7, wherein the first and the second diaphragms are mechanically coupled to each other.

9. The electronic smoking device according to claim 7, wherein the first and the second diaphragms are electrically coupled to each other via a control unit, wherein the control unit is adapted to control at least one motor that opens and closes at least one of the first or the second diaphragms.

10. The electronic smoking device according to claim 3, wherein the electronic smoking device comprises at least one sliding obstruction that is movable across the first gas conduit, the second gas conduit, or both.

11. The electronic smoking device according to claim 1, wherein the electronic smoking device is adapted to adjust the ratio of the flow resistances of the first and the second gas conduits dependent on a flow rate of air passing through the electronic smoking device when it is in use.

12. The electronic smoking device according to claim 3, wherein the electronic smoking device comprises a gas flow-through element with a first opening and a second opening, the first and second openings forming the first and second flow-through openings, the gas flow-through element being repeatedly mountable to and demountable from the electronic smoking device.

13. The electronic smoking device according to claim 3, wherein the electronic smoking device comprises a gas flow through element with at least two pairs of first and second openings with differently sized first openings, wherein the pairs can respectively be brought into communication with the first and the second gas conduits, and wherein the total size of the first and second openings of one of the pairs corresponds to the total size of the first and second openings of the other one of the pairs.

14. The electronic smoking device according to claim 3, wherein the electronic smoking device comprises a gas flow-through element with at least one first opening and at least one second opening, the first and second openings forming the first and second flow-through openings, the gas flow-through element being rotatably mounted to the electronic smoking device.

15. The electronic smoking device according to claim 1, wherein the electronic smoking device is adapted to change an atomization power supplied to the atomizer depending on the flow resistance of the first gas conduit.

* * * * *